US005172533A

United States Patent [19]

Face, Jr.

[11] Patent Number: 5,172,533

[45] Date of Patent: Dec. 22, 1992

[54] RESILIENT FINGER JOINT FOR CONCRETE SLABS

[75] Inventor: Samuel A. Face, Jr., Norfolk, Va.

[73] Assignee: Face Construction Technologies, Inc., Norfolk, Va.

[21] Appl. No.: 769,647

[22] Filed: Oct. 2, 1991

[51] Int. Cl.[5] ..... E04B 1/68

[52] U.S. Cl. ..... 52/396; 52/573; 404/47

[58] Field of Search ..... 52/573, 396, 459, 461; 404/52, 51, 47, 37, 33, 40, 43, 48, 49, 55, 47

[56] References Cited

U.S. PATENT DOCUMENTS

| | | | |
|---|---|---|---|
| 1,978,283 | 10/1934 | Rein | 404/47 |
| 2,181,018 | 11/1939 | Hughes et al. | 404/47 |
| 3,165,986 | 1/1965 | Hirst et al. | 404/47 |
| 3,677,145 | 7/1972 | Wattiez | 404/47 |
| 4,616,954 | 10/1986 | Taga | 52/396 |

*Primary Examiner*—David A. Scherbel
*Assistant Examiner*—Matthew E. Leno
*Attorney, Agent, or Firm*—Jacobson, Price, Holman & Stern

[57] ABSTRACT

A joint between adjacent concrete slabs for overcoming existing problems which occur due to large scale relative movement of adjacent concrete slabs which results from the slabs shrinking when aging. More specifically, a resilient finger joint for concrete slabs is provided which allows and adjusts for relative vertical movements of adjoining slabs with the joint including an arrangement for absorbing vibrations and impact loads encountered which result from traffic passing over the joint between adjacent slabs. The joint includes a plurality of fingers supported by a resilient bed. The fingers are positioned in staggered, interdigitated relation and each finger is associated with an anchor alongside of and partially overlapping one end of the adjacent finger with a pivot pin or shaft interconnecting the anchors and fingers with each finger including an end that is free of an opposing anchor but supported by the resilient bed. The anchors are retained in place by a bonding material which surrounds the anchor and bonds it to an adjoining concrete slab with the bonding material serving as a portion of a traffic bearing surface between the concrete slabs and the finger/anchor assembly.

10 Claims, 1 Drawing Sheet

RESILIENT FINGER JOINT FOR CONCRETE SLABS

BACKGROUND OF THE INVENTION

1. Field of the Invention

The present invention generally relates to a joint between adjacent concrete slabs for overcoming existing problems which occur due to large scale relative movement of adjacent concrete slabs which results from the slabs shrinking when aging. More specifically, a resilient finger joint for concrete slabs is provided which allows and adjusts for relative vertical movement of adjoining slabs with the joint including an arrangement for absorbing vibrations and impact loads encountered which result from traffic passing over the joint between adjacent slabs. The joint includes a plurality of fingers supported by a resilient bed. The fingers are positioned in staggered, interdigitated relation and each finger is associated with an anchor alongside of and partially overlapping one end of the adjacent finger with a pivot pin or shaft interconnecting the anchors and fingers with each finger including an end that is free of an opposing anchor but supported by the resilient bed. The anchors are retained in place by a bonding material which surrounds the anchor and bonds it to an adjoining concrete slab with the bonding material serving as a portion of a traffic bearing surface between the concrete slabs and the finger/anchor assembly.

2. Description Of The Prior Art

Various types of joints between slabs have been provided but generally have failed to effectively solve the edge problems associated with joints between adjacent concrete slabs. Elastic fillers, metal sliding plates and metal finger joints have been utilized in joints between adjacent concrete slabs and generally have been found to be too expensive or otherwise impractical. One of the more successful arrangements has been the use of metallic finger plates which supposedly allow retention of the surface plane of the slabs over the joint without any uneven surfaces thereby eliminating bumps that might occur when traffic passes over the joint. The traffic is borne by the individual fingers which in many cases remain sufficiently parallel to the concrete surface to function. However, in many other cases, the edges of the concrete slab curl and the fingers which are, in effect, extensions of the concrete slab, also move relative to the designed plane surface of the slab and because the fingers extend from the slab, edge curling of the slab causes the ends of the cantilevered fingers to move relatively more than the slab itself. Further, the metallic fingers are rigidly attached to the slab and the fastening system which holds them in place is subject to the vibration an significant mechanical stresses which occur when the traffic crosses the joint since the cantilever loads imparted to the fingers by vehicular traffic are quite destructive with a relatively large number of the fingers in such installations breaking away from the concrete slabs.

The following U.S. patents disclose the state of the art in this field of endeavor.

U.S. Pat. No. 2,207,085
U.S. Pat. No. 2,263,824
U.S. Pat. No. 2,743,652
U.S. Pat. No. 3,217,614
U.S. Pat. No. 3,698,292
U.S. Pat. No. 4,504,170

None of the rigid systems have a mechanism which allows the system to adjust to the relative vertical movements of the adjoining slabs and none of the systems have means for absorbing vibrations and impact loads from traffic. Further, none of the prior art utilizes a plurality of interdigitated fingers mounted in a resilient bed combined with anchors which pivotally support one end of the fingers with a bonding material forming a traffic bearing surface between the plane surface of adjacent concrete slabs by forming a continuous surface with the slab and fingers as disclosed in this application.

SUMMARY OF THE INVENTION

An object of the invention is to provide a resilient finger joint for concrete slabs which solves existing problems associated with relative vertical movement of substantial amplitude between adjacent concrete slabs in the form of a plurality of rigid fingers supported in a resilient bed which bridges the joint between adjacent concrete slabs with the fingers also bridging the joint and being interdigitated with a pivot pin or shaft connecting one end of alternating fingers to one of the concrete slabs by anchoring elements connected to the concrete slab with bonding material fixedly bonding the anchoring elements to the concrete with the bonding material also serving as a traffic bearing surface between the slabs and the fingers and anchoring elements.

Another object of the invention is to provide a resilient finger joint between adjacent concrete slabs which allows for relative vertical movements of the adjoining slabs and will effectively absorb vibrations and impact loads from traffic while maintaining continuity of a load supporting surface across the joint between the concrete slabs by the use of a plurality of interdigitated fingers which are not rigidly attached to the concrete slabs thereby eliminating shock induced degradation of the bond between the slab and joint.

A further object of the invention is to provide a resilient finger joint for concrete slabs in which the components of the joint move relative to each other as the edges of the slab curls or the edges of the slabs move vertically with the joint allowing impact traffic loads to deform the system to prevent high stresses from being imparted to the traffic vehicles.

Still another object of the invention is to provide a resilient finger joint for concrete slabs to provide a relatively smooth joint between slabs and accommodate relative vertical movement of adjacent slabs with the joint effectively providing a relatively smooth transition surface between the slabs which is longlasting and dependable even under high traffic volume and heavy traffic loads.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
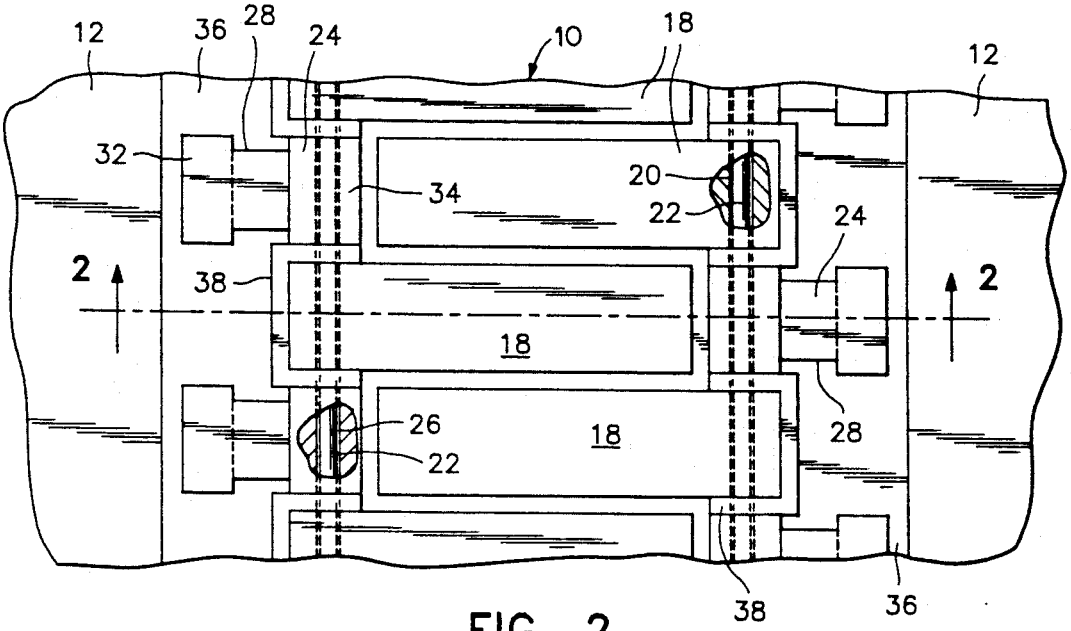
FIG. 1 is a top plan view, with portions broken away, illustrating the resilient finger joint for concrete slabs of the present invention.
Figure 2:
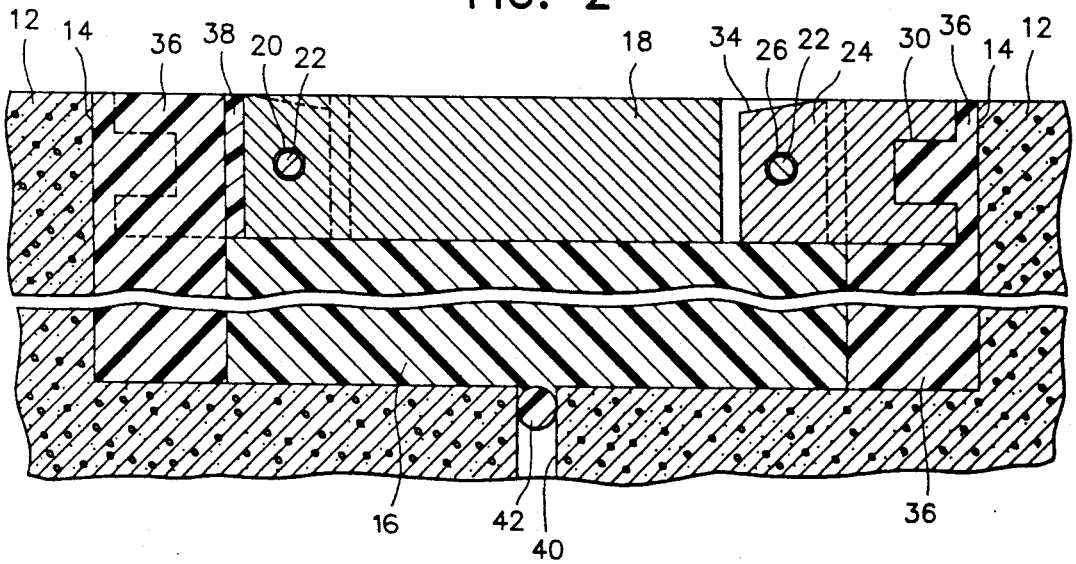
FIG. 2 is a transverse sectional view taken substantially upon a plane passing along section line 2—2 on FIG. 1, on an enlarged scale, illustrating the structural details of the present invention.
Figure 4:
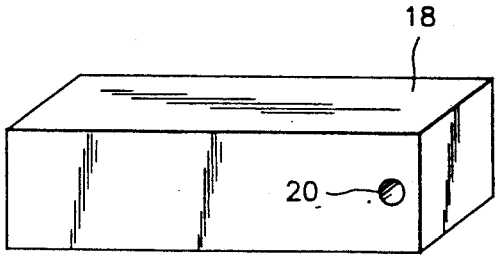
FIG. 4 is a perspective view of one of the fingers used in the joint of this invention.

Referring now specifically to the drawings, the resilient finger joint is generally designated by reference numeral 10 and is interposed between the edges of adjacent concrete slabs 12. The adjacent edges of the concrete slabs 12 are provided with a recess 14 which extends downwardly from the upper surface of the slabs for a predetermined relatively short distance which may vary but may range between 1 and 3 inches. Positioned in the bottom of the cavity formed by the recesses 14 is a bed 16 of plastic material that may be cast in place and is preferably a solid urethane material having some resiliency but also providing a resilient support for the other components of the joint 10. Positioned above and resting on the resilient urethane bed is a plurality of rigid elongated fingers 18 which, as illustrated in FIG. 4, are in the form of elongated blocks of solid material having a transverse configuration which is square or rectangular and provided with a transverse centrally located aperture 20 adjacent one end thereof. The bottom surface of the fingers 18 rest on the bed 16 and the upper surface of the fingers 18 are generally parallel with and form an extension of the plane of the top surface of the adjacent concrete slabs 12. The fingers 18 may be constructed of a substantially rigid plastic or metal. As illustrated in FIG. 1, the fingers 18 are oriented in staggered interdigitated relation with the fingers being pivotally supported from the respective slabs by a pivot pin or shaft 22 with every other finger being supported by one of the shafts 22 and the alternate interdigitated fingers being supported by the other shaft 22 from the other concrete slab. The pivot pins or shafts 22 enable the fingers 18 to move in relation to each other as permitted by the resiliency of the bed 16 so that a substantially continuous surface between the slabs 12 is formed by the fingers 18 but yet the fingers 18 are not rigidly connected to either of the slabs thus enabling them to absorb vibrations and high impact loads from vehicular traffic.

Figure 3:
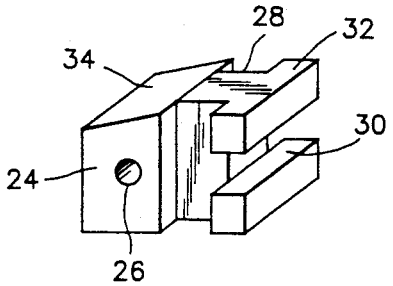
FIG. 3 is a perspective view of one of the anchor elements.

The shafts 22 are anchored to the concrete slabs by anchor elements 24 which, as illustrated in FIG. 3, are each generally in the form of a block having a transverse aperture 26 therein for alignment with the apertures 20 in the fingers 18 for receiving the pivot pin or shaft 22 therethrough. As illustrated, the end of the block 24 having the aperture 26 therethrough is oriented between adjacent fingers which are spaced apart and the anchors 24 are in alignment with the fingers attached to the opposite slab. Thus, each anchor pin or shaft 22 extends ultimately through one end of the finger 18 and the anchor 24. The opposite side surfaces of the anchor 24 includes vertical recesses 28 of generally rectangular configuration and the end of the anchor remote from the transverse aperture 26 is provided with a centrally disposed transversely extending recess 30 thus forming vertically spaced, laterally extending lugs 32 at the upper and lower surfaces of the anchor 24. The top surface of that portion of the anchor 24 having the transverse aperture 26 therein is slightly downwardly inclined at 34 so that the corner of the anchor element 24 adjacent the finger 18 with which it is aligned is slightly below the surface of the finger 18.

A bonding material or "bonding laminant" of epoxy material bonds the anchors 24 to the concrete slabs 12 with the epoxy bonding material flowing into and filling the recesses 28 and 30 thereby securely bonding the epoxy material to the anchors 24 with the bonding material also bonding the anchors to the adjacent concrete. Also, the upper surface of the bonding material 36 forms a traffic bearing surface between the concrete slab and the anchor and finger assembly. An isolator 38 of resilient material is optionally provided between the end of the finger 18 having the pivot pin or shaft extending therethrough and the adjacent bonding material 36 and between the end of the finger 18 and the adjacent anchors 24 with the isolator being of generally U-shaped configuration as illustrated in FIG. 1 and being constructed of resilient plastic or rubber material. If there is a space 40 between the adjacent concrete slabs 12, this can be filled by a resilient seal 42 which may be resilient rubber or plastic material having a diameter sufficient to frictionally engage the adjacent surfaces of the space 40.

The fingers may have a length of approximately $4\frac{1}{2}''$ and a width of 1' and a depth of at least 1" and possibly more with the apertures 20 and 26 closely receiving a stainless steel rod having a diameter of $\frac{1}{4}''$. The apertures may be located approximately $\frac{1}{2}''$ from the ends of the fingers and anchors and the length of the anchors may be $1\frac{3}{4}''$ and the inclined top surface 34 may slant downwardly a total of approximately $\frac{1}{8}''$. The recess 30 may have a width of $\frac{3}{8}''$ and the recesses 28 may have a width of $\frac{1}{2}''$ and a depth of 3/16". However, these dimensions may vary depending upon the installational requirements of the joint.

The components of the resilient finger joint of this invention impart a positive characteristic to the joint between the slabs and provides an effective solution especially between slabs which are post-tensioned in which the problems associated with large scale relative movements of adjacent concrete slabs as they shrink during aging is exacerbated. The resilient finger joints effectively absorb impact loads, shock loads and vibrations resulting from vehicle traffic passing over the joint since there are no rigid attachments to the concrete slab which reduces or eliminates shock induced degradation of the bond between concrete slabs and joints which have previously existed. As the slab edges curl, the joint elements can move relative to each other thus allowing the transiting loads to deform the system thereby preventing high stresses from being imparted to the vehicle. Even if excessive curl or other unexpected slab movements create unacceptable differences in elevation between the adjacent slabs the top of the fingers can be ground down by using a grinding wheel or other abrasive implement to their original relative elevations thus maintaining a smooth surfaced joint between adjacent concrete slabs.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A joint for concrete slabs having adjacent edges subject to relative vertical movement, said joint comprising a plurality of rigid fingers oriented in interdigitated relationship and bridging the joint between adjacent slabs, means pivotally securing the ends of every other finger to one of the slabs, means pivotally securing the other fingers to the other concrete slab whereby alternating fingers have one end pivoted to a slab for pivotal movement about a horizontal axis and the opposite end free of the slabs for movement in a vertical plane, said fingers having upper surfaces generally parallel to and forming extensions of the plane of the concrete slabs throughout the length of the fingers to form a traffic bearing surface, and a resilient bed underlying and supportingly engaging said fingers throughout the length of the fingers with the fingers and bed oriented in downwardly extending recesses in the adjacent edges of adjacent concrete slabs.

2. A joint for concrete slabs having adjacent edges subject to relative vertical movement, said joint comprising a plurality of rigid fingers oriented in interdigitated relationship and bridging the joint between adjacent slabs, means pivotally securing the ends of every other finger to one of the slabs, means pivotally securing the other fingers to the other concrete slab whereby alternating fingers have one end pivoted to a slab and the opposite end free of the slabs, said fingers having upper surfaces generally parallel to and forming extensions of the plane of the concrete slabs, and a resilient bed underlying and supportingly engaging said fingers with the fingers and bed oriented in downwardly extending recesses in the adjacent edges of adjacent concrete slabs, said means pivotally securing the fingers to the slabs including a plurality of anchors with the anchors being positioned between and spacing the fingers apart, a pivot shaft extending through the anchors and fingers on one concrete slab and another parallel pivot shaft connecting the fingers and anchors on the other concrete slab and means securing the anchors to the respective concrete slabs.

3. The joint as defined in claim 2 wherein said means securing the anchors to the concrete slabs includes a bonding material enclosing and rigidly affixed to one end portion of each anchor in spaced relation to the pivot shaft with the bonding material being bonded to the surface of the recess in the concrete slab, the upper surface of the bonding material, anchor and fingers generally being parallel to and forming an extension of the plane of the concrete slab surface.

4. The joint as defined in claim 3 wherein said bed is constructed of urethane.

5. The joint as defined in claim 4 wherein said bonding material is an epoxy material.

6. The joint as defined in claim 3 wherein an isolator is provided between each anchor and finger, said isolator being constructed of resilient material to enable relative movement with the isolator absorbing and resisting such movement.

7. A joint for concrete slabs having adjacent edges subject to relative vertical movement with a gap defined between adjacent edges of the slabs, each of said slabs including a recess communicating with the top surface of the slab, a plurality of rigid fingers positioned in the recesses with the fingers bridging the gap between adjacent edges of the slabs and including upper surfaces forming continuations of upper surfaces of the concrete slabs to form a substantially continuous traffic bearing surface between the concrete slabs, said fingers being positioned alongside of each other, means connecting the ends of alternate fingers to the adjacent edges of the concrete slabs to enable relative movement of the fingers in relation to each other and to the slabs and a bed of resilient material in said recesses and bridging the gap between adjacent edges of the concrete slabs, said bed of resilient material underlying and engaging said fingers throughout the length of said fingers to provide a resilient support for the fingers for absorbing vibrations and impact loads encountered when traffic passes over the fingers.

8. The joint as defined in claim 7 wherein said means connecting the ends of the fingers to a concrete slab includes a generally horizontally disposed pivot shaft extending through end portions of alternating fingers and means mounting the shaft in said recess to enable the fingers to pivot about the axis of the shaft and means anchoring each shaft to the recess in the concrete slab.

9. The joint as defined in claim 8 wherein said means anchoring each shaft includes a plurality of anchor members in the form of blocks having one end oriented between alternating fingers and receiving the pivot shaft therethrough, each block having another end extending beyond the ends of the fingers into the recess, and bonding material bonding the blocks to the recess, the upper surface of the bonding material and blocks forming continuations of the traffic bearing surface of the concrete slabs and being coextensive with the upper surface of said fingers.

10. The joint as defined in claim 9 wherein each of said fingers includes recesses in the end thereof projecting beyond the fingers for receiving said bonding material to provide an effective mechanical bond between the anchor blocks and the bonding material.

* * * * *